US006267374B1

(12) United States Patent
Bourbeau

(10) Patent No.: US 6,267,374 B1
(45) Date of Patent: Jul. 31, 2001

(54) BRAILLE GAME BOARD

(76) Inventor: Rosaire Bourbeau, 910 Labonté, Lonqueuil Québec (CA), J4H 2R8

( * ) Notice: Subject to any disclaimer, the term of this patent is extended or adjusted under 35 U.S.C. 154(b) by 0 days.

(21) Appl. No.: 09/310,169

(22) Filed: May 7, 1999

Related U.S. Application Data

(60) Provisional application No. 60/084,785, filed on May 8, 1998.

(51) Int. Cl.[7] ..... A63F 3/00

(52) U.S. Cl. ..... 273/236; 273/DIG. 27

(58) Field of Search ..... 273/271, 282.1, 273/287, 265, 247, 249, 236

(56) References Cited

U.S. PATENT DOCUMENTS 2,053,598 * 9/1936 Blau ..... 273/265
2,464,146 * 3/1949 Mohler ..... 273/DIG. 27
2,536,188 * 1/1951 Kulakusky ..... 273/DIG. 27
3,746,343 * 7/1973 Shapiro ..... 273/DIG. 27
4,684,136 * 8/1987 Turner ..... 273/271
5,407,206 * 4/1995 Cohen ..... 273/249

* cited by examiner

*Primary Examiner*—Mark S. Graham
*Assistant Examiner*—Raeann Gorden
(74) *Attorney, Agent, or Firm*—Eric Fincham

(57) ABSTRACT

A Braille device comprising a Braille board and a plurality of Braille indicating devices, the board having at least one major face with a plurality of longitudinally and transversely extending dividers to divide the major face into a plurality of longitudinally and transversely aligned rows of cells, the six recesses formed in each of the cells, the indicating devices comprising a plurality of pins each having a shaft sized to fit within one of the recesses and having an enlarged head portion located at one end thereof. The device may be used for hidden word puzzles, crossword puzzles, and the like.

10 Claims, 2 Drawing Sheets

BRAILLE GAME BOARD

This application claims benefit to U.S. provisional application No. 60/084,785 filed May 8, 1998.

The present invention relates to a Braille game device and more particularly, relates to a board which may be used for various games utilizing Braille.

BACKGROUND OF THE INVENTION

The use of Braille is becoming increasingly widespread as the population lives longer due to the numerous advancements in medicine. However, the loss of eyesight or diminishing visual acuity is an ever increasing problem for the elderly.

The number of devices available for use by the blind is limited. An increasing demand is for devices which can be used for amusement such as is available to the sighted population. Such amusements or diversions include crossword puzzles, hidden word puzzles, mystery word puzzles, and the like.

While certain learning devices have been available in the past, they have generally been limited to those which have been directed to teaching devices for children. One such device is illustrated in U.S. Pat. No. 4,880,384 to Murphy wherein there is shown an apparatus which comprises a plurality of blocks, each of the blocks having a two by three matrix of dots. While suitable for the teaching of children, the board would not be appropriate for the type of puzzles or other uses described above.

SUMMARY OF THE INVENTION

Accordingly, it would be desirable to have a board which is adaptable for use with such puzzles as crossword puzzles, hidden word puzzles, mystery word puzzles, and which may also function as a general writing board for Braille characters.

According to one aspect of the present invention, there is provided a Braille device comprising, in combination, a Braille board and a plurality of indicating devices, the Braille board having at least one major face, a plurality of longitudinally and transversely extending dividers on the major face to thereby divide the major face into a plurality of longitudinally and transversely aligned rows of cells, at least six recesses formed in each of the cells, the indicating devices comprising a plurality of pins, each of the pins having a shaft sized to fit within one of the recesses, each pin having an enlarged head portion located at one end thereof.

The board may be formed of any suitable material and thus, could be of a conventional wood material having the recesses drilled therein or alternatively, it could be formed of injection molded plastic. Similarly, the pins can either be formed of a wood, metallic or plastic material.

The recesses formed in each cell are preferably arranged in the traditional three by two pattern used in Braille.

In lieu of using a plurality of single pins, pin combinations may also be used. Thus, there could be a three pin device, a two pin device, and a one pin device which could form any of the combinations used in Braille. Preferably, there would also be a filler piece to maintain a square empty such as may be useful in crosswords or other word games. The piece could be designed to have one or more pins extending therefrom to fit within the recess or alternatively, it could just sit on any particular cell surface.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENT

Figure 3:
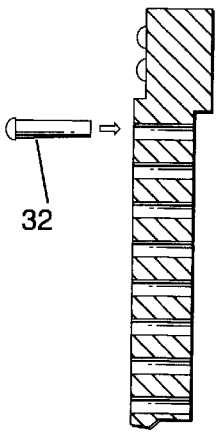
FIG. 3 is a sectional view taken along the line 3—3 of FIG. 1.

Referring to the drawings in greater detail and by reference characters thereto, there is illustrated a Braille board apparatus which is generally designated by reference numeral 10.

Braille board apparatus 10 is comprised of a generally rectangular board having first and second opposed sides 12 and 14 and first and second opposed ends 16 and 18.

On a front surface 20 there is provided raised portions 22 which divide front surface 20 into a plurality of cells which are generally designated by reference numeral 24. In the embodiment illustrated, raised portions 22 are arranged so as to provide a grid work of twenty by twenty—i.e. four hundred cells arranged in rows and columns.

Each cell 24 includes fixed recesses 26, which recesses 26 are arranged in the familiar three by two pattern used for Braille symbols.

On the perimeter of the grid defined by the raised portion 22, there are provided a plurality of Braille indicators for each row and column. The raised Braille indicators 28 are conveniently formed by small raised portions.

Figure 4:
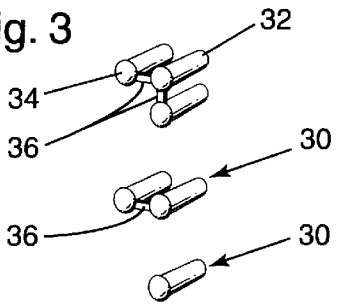
FIG. 4 is a perspective view of three different pin types usable with the Braille device of the present invention.

As shown in FIG. 4, there may conveniently be three different pin combinations. Each pin, which is generally designated by reference numeral 30, may have a shaft 32 and an enlarged head portion 34 at one end thereof. As shown in FIG. 4, there may be three different types of combinations—a three pin combination wherein bridges 36 join the pins or a two pin combination having only a single bridge joining the two pins.

Figure 5:
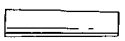
FIG. 5 is a side elevational view of a filler piece which may be used with the Braille game board.
Figure 1:
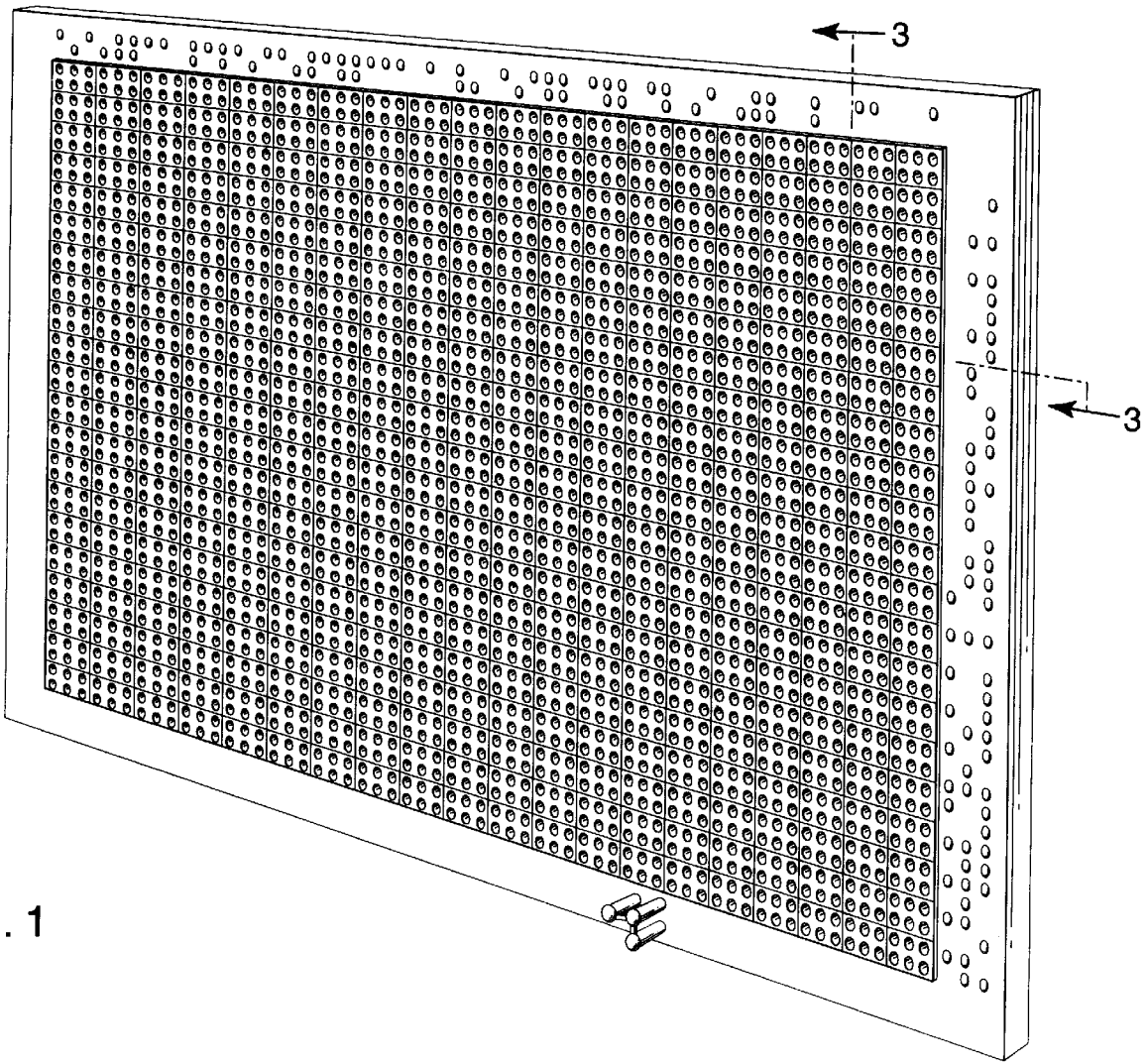
FIG. 1 is a perspective view of a Braille board apparatus according to the present invention.
Figure 2:
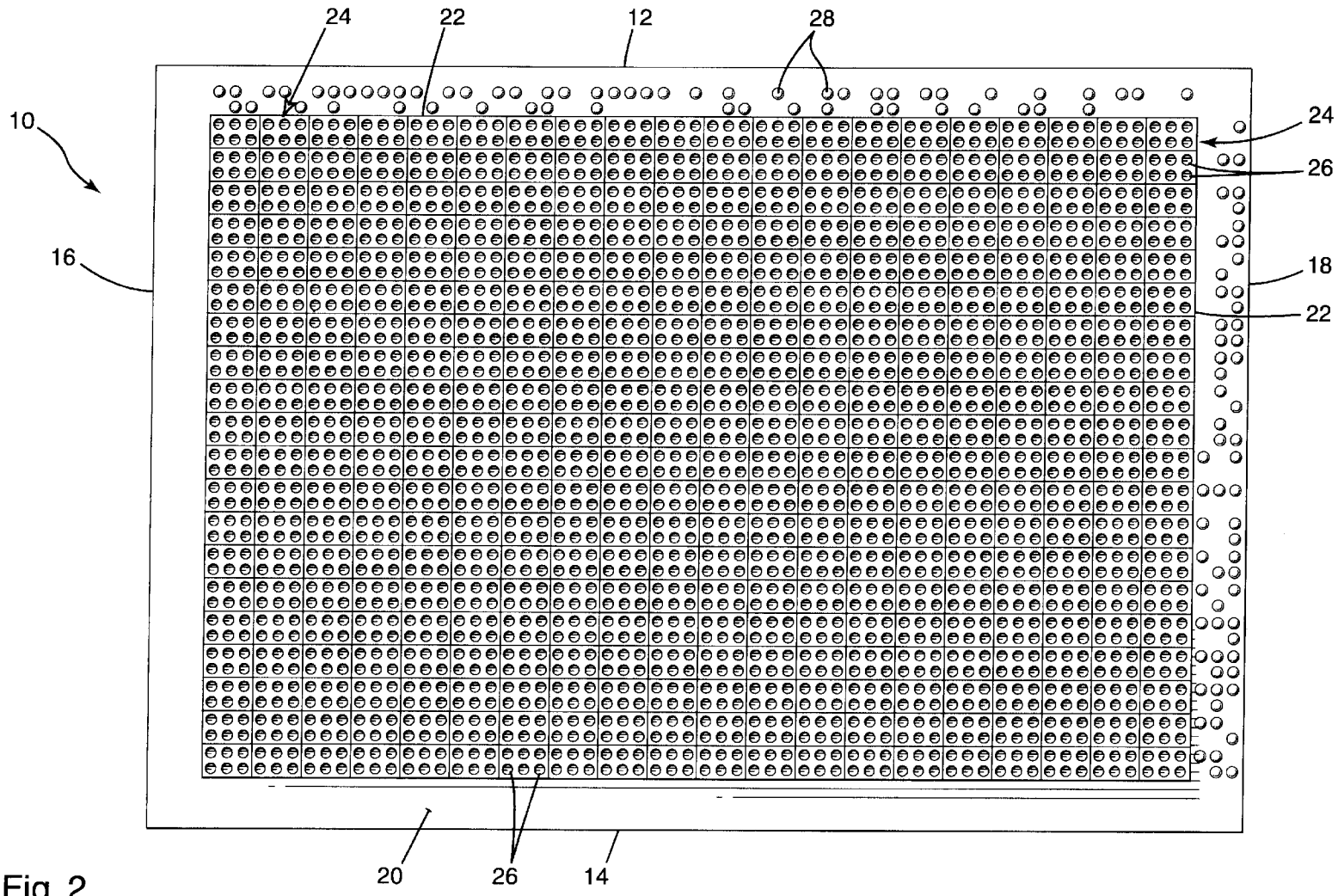
FIG. 2 is a top plan view thereof.

As shown in FIG. 5, a relatively flat member 38 may be utilized to cover one cell completely when that cell is not supposed to receive any pins—such as may be used in crosswords or other types of puzzles.

In operation, suitable markers such as pins with raised heads may be inserted into recesses 26 in cells 24 as required to provide for a board which can then be used for many familiar puzzles such as, for example, hidden word puzzles, crossword puzzles, mystery word puzzles, and the like. In addition, apparatus 10 can also function as a note board for Braille users as well as a board which could be used for teaching.

It will be understood that the above described embodiment is for purposes of illustration only and that changes and modifications may be made thereto without departing from the spirit and scope of the invention.

I claim:

1. A Braille device comprising, in combination, a Braille board and a plurality of indicating devices, said Braille board having at least one major face, a plurality of longitudinally and transversely extending dividers on said major face to thereby divide said major face into a plurality of longitudinally and transversely aligned rows of cells, wherein said longitudinally and transversely extending dividers do not intersect the interior of said cells, at least six recesses formed in each of said cells, said indicating devices comprising a plurality of pins, each of said pins having a shaft sized to fit within one of said recesses, each pin being sized to have an end portion thereof extending outwardly of a recess when placed therein such that said end extending outwardly may function as a Braille indicating device.

2. The combination of claim 1 wherein said recesses in each cell are formed in a three by two pattern and each pin has an enlarged head formed at said end extending outwardly.

3. The combination of claim 2 wherein said indicating means comprises three different pin types, a first pin type having a single head and a single shaft, a second pin type having two spaced apart shafts each having a head thereon and a third pin type having three spaced apart shafts each having a head thereon.

4. The combination of claim 3 further including a blank filler piece designed to completely fill one of said cells.

5. The combination of claim 4 wherein said Braille board is formed of wood.

6. The combination of claim 4 wherein said Braille board is formed of injection molded plastic.

7. The combination of claim 2 wherein said pins are formed of a metallic material.

8. The combination of claim 2 wherein said pins are formed of a plastic material.

9. The combination of claim 2 further including a plurality of Braille indicators exteriorly of said cell indicating said transversely and longitudinally extending rows.

10. The combination of claim 2 wherein each of said enlarged head portions comprises a cylindrical lower portion and a dome shaped upper portion.

* * * * *